United States Patent [19]

Garnett

[11] Patent Number: 4,949,808

[45] Date of Patent: Aug. 21, 1990

[54] AERIAL APPARATUS AND STABILIZING MEANS THEREFOR

[75] Inventor: Edward V. Garnett, Huntington Beach, Calif.

[73] Assignee: Figgie International, Inc., Willoughby, Ohio

[21] Appl. No.: 396,858

[22] Filed: Aug. 22, 1989

Related U.S. Application Data

[63] Continuation-in-part of Ser. No. 307,898, Feb. 7, 1989, Pat. No. 4,941,546.

[51] Int. Cl.[5] ..... E06C 5/38

[52] U.S. Cl. ..... 182/17; 182/63; 212/189

[58] Field of Search ..... 182/17, 2, 65–68; 212/189

[56] References Cited

U.S. PATENT DOCUMENTS

| | | | |
|---|---|---|---|
| 835,153 | 11/1906 | Cooper | 182/67 |
| 1,155,958 | 10/1915 | Richard | 182/17 |
| 1,761,726 | 6/1930 | Havens | 182/65 |
| 3,253,717 | 5/1966 | Krynytzky . | |
| 3,584,703 | 6/1971 | Lane | 182/67 |
| 4,059,170 | 11/1977 | Young . | |
| 4,382,631 | 5/1983 | Johnson . | |
| 4,383,617 | 5/1983 | Hychalk . | |

*Primary Examiner*—Reinaldo P. Machado

*Attorney, Agent, or Firm*—Jones, Day, Reavis & Pogue

[57] ABSTRACT

An aerial apparatus swingable outwardly of a fire truck chassis is stabilized by outriggers on opposite sides of the chassis with the aerial apparatus being swingable to one side or the other only if an extendible section of an outrigger for that side has been moved relative to its base section from a storage position to a fully extended outrigging position on that side. The swinging of the apparatus to a side of the chassis is enabled by withdrawing stop means which is spring urged into the path of rotation of the apparatus to that side. The withdrawal of the stop means is actuated mechanically by means on the extendible section engaging and moving an actuating rod carried by the base section for the extendible section to effect operation of a linkage to withdraw the stop means against its spring bias. On retraction of the extendible section from its fully extended position, the spring urged stop means resets as the extendible section leaves the fully extended position. The base and extendible section are moved vertically about a pivot by hydraulic means having a stroke such that the outrigger may also be used as a jack which engages the ground close to the chassis.

10 Claims, 5 Drawing Sheets

20a
20b
48
44
52
7
54
56
24
20
8
25
9
50
46

AERIAL APPARATUS AND STABILIZING MEANS THEREFOR

The present application is a continuation-in-part of an application filed by Thomas R. Nist and Edward V. Garnett on Feb. 7, 1989, Ser. No. 07/307,898 now U.S. Pat. No. 4,941,546.

This invention relates to stabilizing a laterally swingable and extendible structure, such as an aerial ladder, for example, a fire truck ladder, which can be raised and lowered as well as extended, and particulary to such a structure supported by a platform, such as a rotatable platform, or other base which provides or accommodates the lateral swinging movement of the structure, with the platform or base being mounted on a vehicle.

The application of Nist and Garnett discloses, in a fire truck, extendible stabilizing means in the form of outriggers for both sides of the truck with the construction and arrangement being such that the outriggers on one side only can be set to stabilize the vehicle platform and ladder when it is swung to that side. The application also discloses auxiliary jacks on both sides of the truck which may be set on the side of the truck opposite to the side on which outriggers are set when outriggers are used on one side only. The auxiliary jacks aid in the stabilizing the vehicle against reaction to the discharge of high pressure water from the ladder. In the Garnett and Nist application, Ser. No. 307,898, stop rotation pins are shown positioned in the path of rotation for swinging the ladder laterally and preclude the swinging the ladder outwardly of the truck on either side of its transport or rest position. When outriggers for one side of the truck are set, the pin or pins for precluding the swinging of the ladder to that side are retracted in response to the extension of the outriggers to allow rotation to the swing the ladder to that side. The arrangement is such as to constrain the operation of the ladder to only that side of the truck for which the outriggers are set. In application Ser. No. 307,989, the outriggers are of fixed length, stored vertically, and have pivot shafts about which they are swung between a storage or transport positions, and a working position for each. A crank lever for each outrigger is operated as the outrigger is swung to effect actuation of one of the stop pins to move it out of or into a rotation blocking position. The movement of the pins occurs during a substantial portion of the movement of the corresponding outriggers and begins relatively early in the lowering movement of the outriggers and relatively late in their retraction movement for returning the outriggers to their transport position.

SUMMARY OF THE INVENTION

According to one aspect of the present invention, an outrigger for effecting stabilization in a sector to one side of the angular storage position of a laterally swingable extendible structure has a movable extendible section which is moved linearly relative to a base section to extend the outrigger to its working position for stabilizing the extendible structure for operating in that sector. In the preferred and illustrated embodiment, means responsive to the last part of the movement of the movable section to its fully extended working position effects the release of means for preventing rotation of the extendible structure into a predetermined sector and during the initial part of a retraction movement from the fully extended position, enables the means for blocking rotation into that sector from the storage position of the extendible device. Other stop rotation means controlled by other outrigger means constrains the operation of the ladder to the outrigged sector.

In accordance with another aspect of the present invention, actuating means for setting and disenabling the rotation preventing means for preventing the movement of the extendible structure from its storage position for operation in one sector only is associated with each outrigger, each outrigger having a movable, extendible section and a base section, and stop rotation actuating means including an actuating element movable with the movable section and a cooperating element engaged by the actuating element during the last part of the movement to, or during the initial movement away from, its fully extended working position, to effect the disabling and the enabling respectively of the rotation preventing means.

Another feature of the present invention is the provision of hydraulic cylinder means for raising and lowering each outrigger about the pivot axis for the base end of the outrigger, with the cylinder means having a sufficient stroke to enable the outrigger to work as an auxiliary jack which operates close to the chassis.

The outriggers preferably each control and actuate corresponding rotation stop members positioned in the path of the rotation of a turntable supporting the extendible structure, the stop members being spring biased to their rotation disabling position and moved to rotation enabling position against their spring bias by an operating linkage having an actuating assemly on the outrigger comprising a rod actuated by the movement of the movable section of the outrigger as it approaches its fully extended position to effect the movement of the rotation stop member to a table-clear position, the actuating rod being connected to operate a crank lever mounted on the outrigger which inturn operates an operating linkage connected between the crank and the stop member, the linkage preferably comprising a connecting rod connected to the crank and extending approximately though the extended axis of the pivotal support for the base end of the outrigger to minimize or eliminate the effect of raising or lowering of the outrigger about the pivot axis on the operating characteristics of actuating means for the rotation stop pin.

In the preferred embodiment as applied to a fire truck, the base ends of the outriggers are each pivoted to the bottom of the chassis on one side and extend underneath the chassis so as to be extendible outwardly of the other side of the chassis, the outrigger being movable about the pivot axis by a hydraulic jack cylinder on the side of the truck to which the outrigger is to extend.

Figure 1:
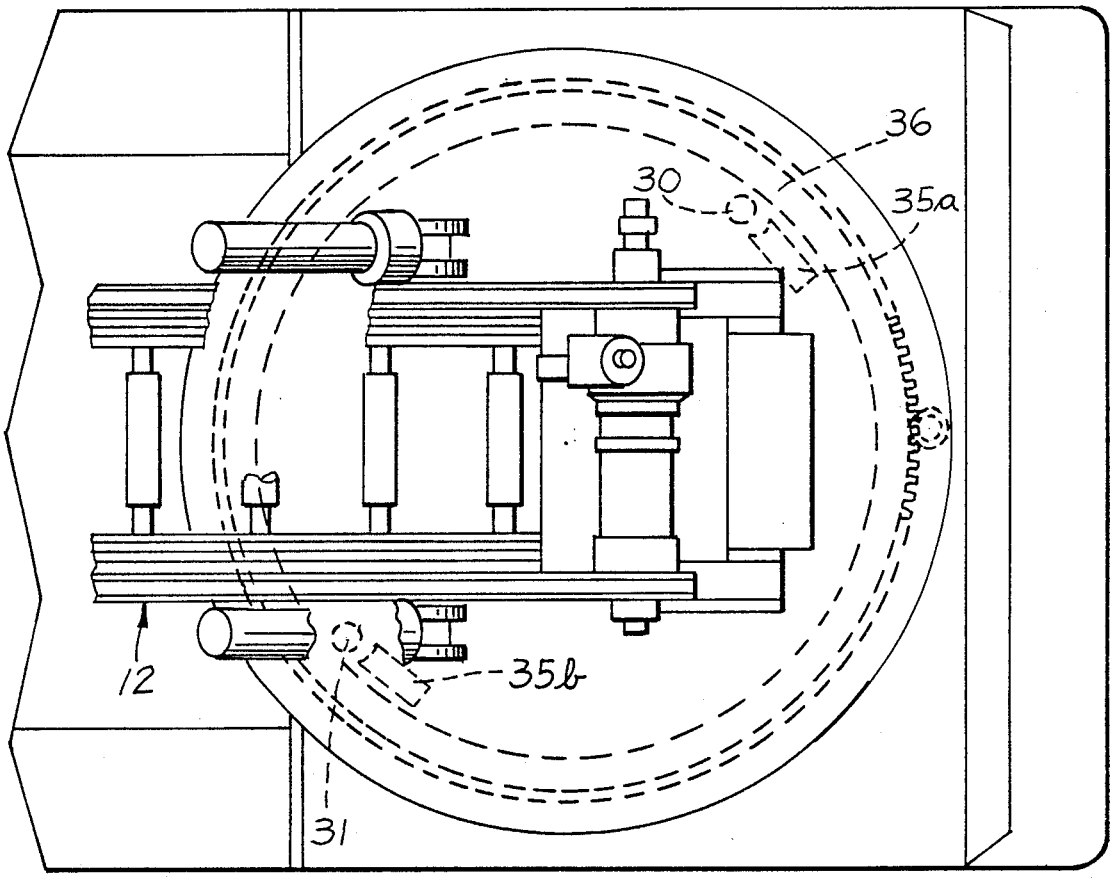
FIG. 1 is a fragmentary top plan view of the rear portion of a fire truck embodying the present invention.
Figure 1A:
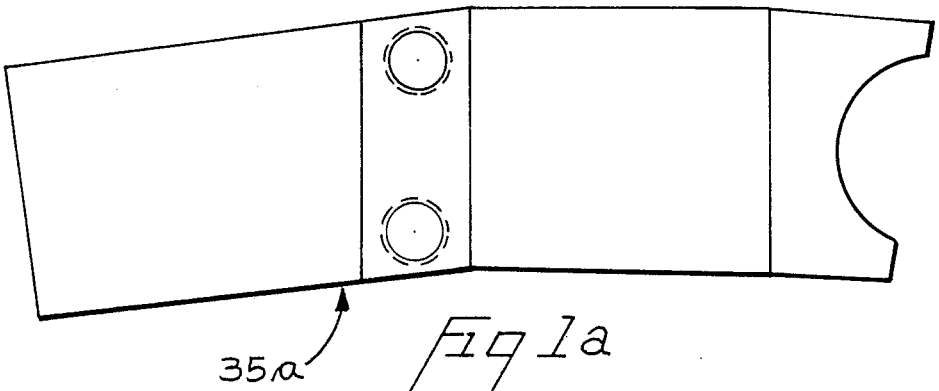
FIG. 1*a* is an enlarged view of a rotation stop element shown in dotted lines in FIG. 1.

Referring initially to FIG. 1, a fire truck 10, shown fragmentarily, is equipped with a conventional aerial ladder 12 having its base end pivoted on a rotatable base or table 14 located near the rear of the truck. Conventional hydraulic cylinders and means are provided to raise and lower the ladder vertically from and to a horizontally extending rest position in which the ladder extends horizontally and parallel to the length of the truck along the centerline of the truck. The angular position of rotatable table 14 and ladder, about the axis of rotation, for the ladder's rest postion may be termed the rest or zero angular position of the table and ladder. The table may be rotated in either direction from its zero angular position to position the ladder at any point in a circular path to provide access for fire fighters to the upper portions of a burning building or any other emergencies which would involve the use of an aerial ladder. When ladder 12 is to be extended outwardly of the sides of the truck or raised vertically for a water tower, the truck and ladder are conventionally stabilized by the use of outriggers and/or auxiliary jacks.

In the illustrated embodiment, the fire truck has two outriggers 20, 22, which are extendible from the left and right sides of the truck respectively to respectively stabilize the truck for operation of the ladder outwardly of the side of the truck from which the outrigger extends. Each outrigger may also be used as a jack type stabilizer, when not in use as an outrigger, which engages the ground near the fire truck, as distinguished from an outrigger which extends outwardly of the side of the truck for a considerably greater distance to provide a significantly wider base for stabilizing purposes. Auxiliary jacks are commonly used to stabilize the truck and ladder against the reaction forces of high pressure streams of water discharged from the ladder toward the other side of the truck from the jack.

Figure 2:
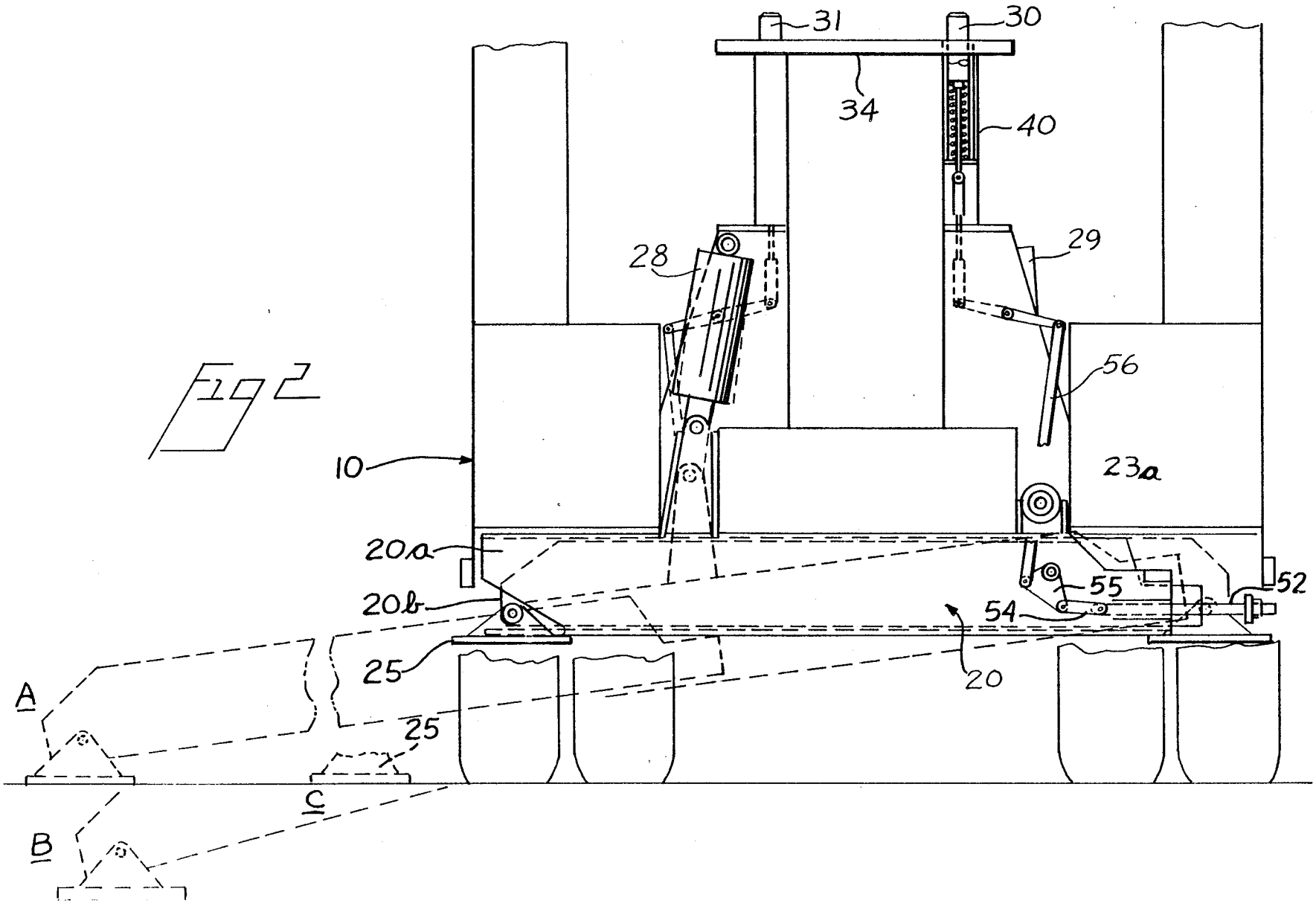
FIG. 2 is a rear plan view of the fire truck of FIG. 1 with parts removed and showing extended outrigger positions.
Figure 3:
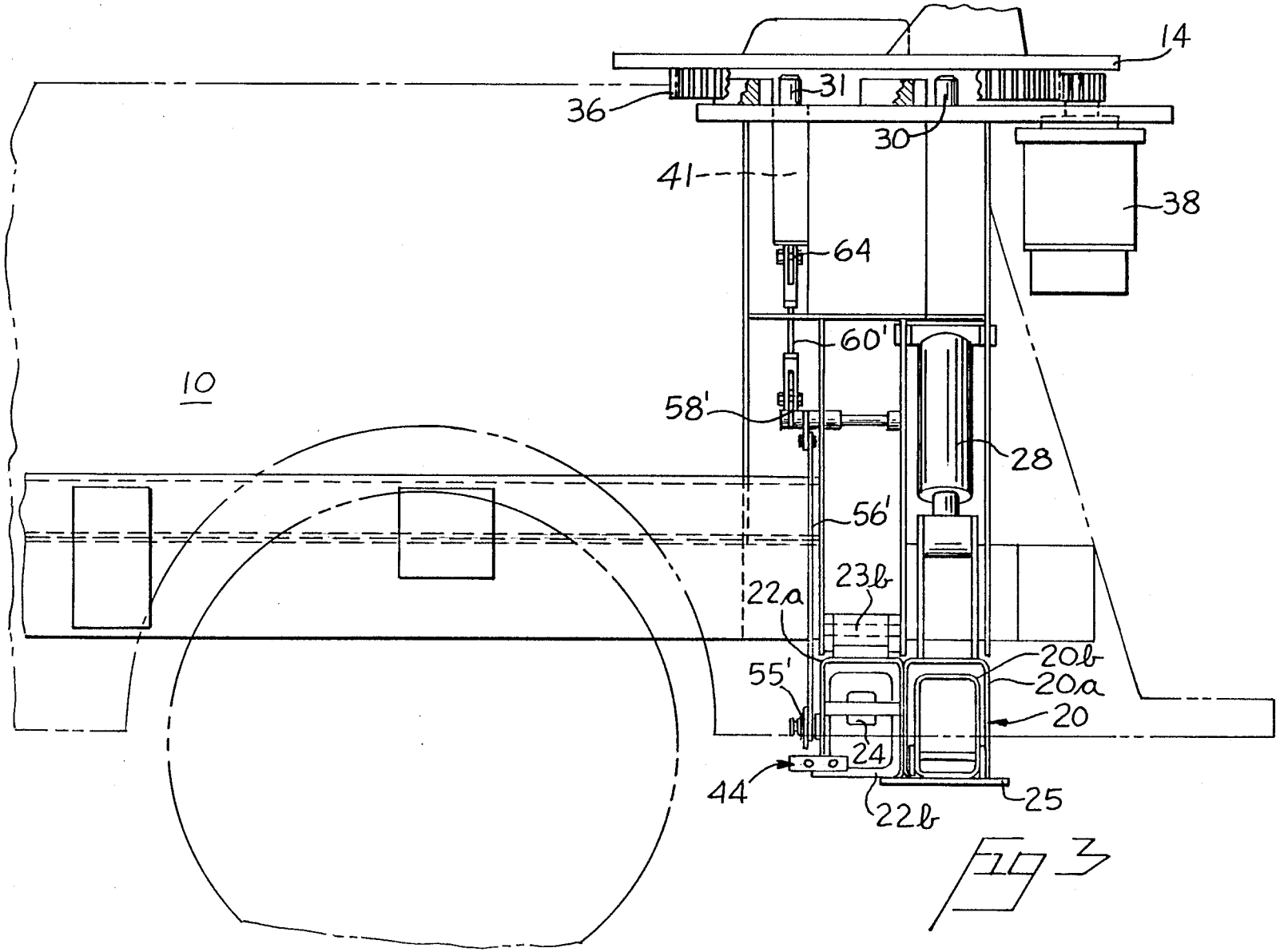
FIG. 3 is a fragmentary left side of the truck of FIG. 1 with parts removed.
Figures 4, 5, 6, 7, 8, 9:
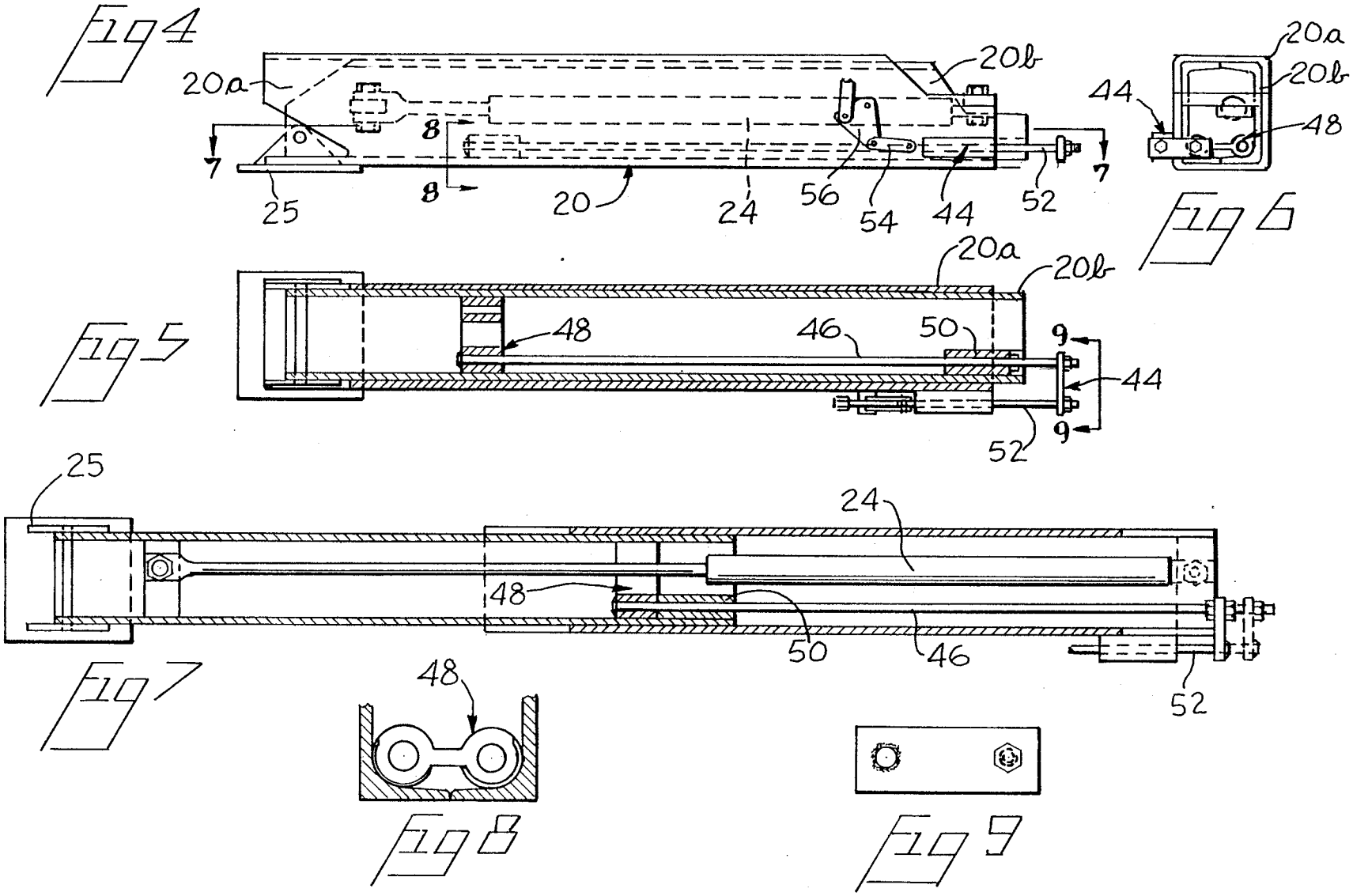
FIG. 4 is a detached view of the outrigger shown is side elevation in FIG. 2.
FIG. 5 is a sectional view of the outrigger of FIG. 4 looking from line 5—5 of FIG. 4.
FIG. 6 is an elevational view looking at the right end of the outrigger as shown in FIG. 4.
FIG. 7 is a horizontal cross sectional taken along line 7—7 of FIG. 4.
FIG. 8 is a fragmentary cross sectional view along line 8—8 of FIG. 4.
FIG. 9 is an enlarged detached view looking from line 9—9 of FIG. 5.

As shown in FIGS. 2 and 3, the outriggers extend crosswise of the underside of the chassis with the outrigger having base sections 20*a*, 22*a*, respectively, of a length approximate to the width of the truck. The base sections are respectively pivoted, at a base end, to the chassis adjacent the side of the truck opposite to the side from which the outrigger is to extend. The outriggers 20, 22, also have respective movable sections 20*b*, 22*b*, which are in telescoped relationship within the respective base section when the outrigger is not in use. A respective hydraulic cylinder 24 is connected between each base section and the movable section of each outrigger for extending the movable section to and from positions outwardly of the truck and to retract the sections. The hydraulic cylider 24 for the outrigger 20 is shown in FIGS. 2, 4, and 7 and the outrigger 20 is partially shown in dashed lines in two fully extended stabilizing positions A and B in FIG. 2. Also, a ground level (without ground compression) jack position C is indicated in FIG. 2 by dashed lines for the pivoted shoe 25 on the outer end of the movable section. The outriggers 20, 22 each have a respective hydraulic cylinder 28 29 on the side of the truck from which it is extendible for lowering and raising the outer end of the outrigger to enable engagement of the extended outrigger with the ground and for transmitting toppling forces of the ladder to the outrigger or the reaction forces to water discharge when operating as a hydraulic jack.

While both outriggers may be extended to fully stabilize the truck regardless of where the ladder is swung; but when in use in confined areas, there may be insufficient space for fully extending both outriggers. In which case, the outrigger for the side to which the ladder is to be working may be set in a fully extended position to give maximum stability for ladder forces acting to topple the truck and ladder to that side with the outrigger on the other side of the truck being extended a short distance and lowered to function as an auxiliary jack for stabilizing against water discharge reaction forces. Contrary to conventional hydraulic cylinders for raising and lowering outriggers having a telescoped extendible section, the stroke of the respective hydraulic cylinder for raising and lowering each outrigger is sufficient to use the outrigger as an auxiliary jack. This is a longer stroke than that required for operation as an outrigger only as will be understood by those in the art, and requires the stoke to be sufficient to lower the outrigger to the ground, position C in FIG. 2 and to accommodate additional movement by reason of ground compression.

To assure the setting of an outrigger before the ladder can be swung to a side of the truck from its rest or zero angular position, stop rotation retractable pins 30, 31 are provided to preclude rotation to respective sides unless an outrigger has been set for that side. The pin 30 is in its stop rotation position unless the outrigger 20 is fully extended and the pin 31 is in its stop rotation position unless the outrigger 22 is fully extended. In their stop rotation positions, the pins extend upwardly from a turntable supporting platform 34 into the path of stop blocks 35*a* and 35*b* respectively carried by the underside of the turntable, which is supported for rotation on the platform by an external gear rotation bearing 36 driven by a motor 38. The platform 34 is supported by the chassis and the motor 38 is mounted on the platform.

The stop pin 30 is engaged by stop block 35*a* to prevent rotation of the turntable and ladder from their rest position to the left side of the truck if the motor is operated to swing the ladder to that side without setting the outrigger 20 to its fully extended position. Similarly, the stop pin 31 is engaged by the stop block 35*b* to prevent the motor from swinging the ladder to the right side of the truck unless the outrigger 22 is fully extended. It will be noted that the rotation stop members are approximately 180° apart so that each stop pin not only precludes rotation into the sector cotrolled by it from the zero angular position, but also prevents the ladder from being swung over 180° into the unstabilized sector when the ladder is operating outwardly from the opposite side of the truck.

Each stop pin is retracted from its position for stopping rotation from the rest position to its respective side of the truck in response to the extension of the outrigger for that side.

In accordance with the present invention, the rotation stop pin is not actuated to be withdrawn from the path of the stop blocks on the turntable until outrigger controlling the pin approaches a substantially fully extended position. Also, each pin is preferably released for resetting to its stop position in response to the initial retraction movement of its respective outrigger from its fully extended position. In addition to assuring the full extension of the outrigger before swinging the ladder to one side of the truck, such an arrangement facilitates the use of the outrigger as an auxiliary jack when the other outrigger is extended without causing a withdrawing movement of the respective stop rotation pin.

The stop pins 30, 31 operate in respective spring cylinders 40, 41 which bias the stop pins to their stop rotation positions. Each of the pins is actuated to a retracted position against the bias of its respective spring cylinder in response to the extendible section of its corresponding outrigger being moved to its fully extended position. The means for operating the stop pin 30 to its retracted position will be first described.

The outrigger 20 carries an actuating assembly 44 for actuating the pin 30 to its retracted position. This assembly includes an actuating rod 46 disposed along the inner bottom of the extendible section **20*b*. The rod extends from outwardly of the inner ends of the extendible section and the base section lengthwise along the bottom of the extendible section to terminate in a slide structure 48 fixed to the rod end. The rod passes though an actuating block 50 fixed to the extendible section adjacent its inner end so that the actuating block moves along the rod as the extendible section moves relative to the base section. The rod is yieldably held against movement as the section is extended by the spring cylinder 40, as will be apparent as the description of the mechanism for withdrawing the stop pin 30 is completed. As the section 20*b* approaches its fully extended position, preferably within about 3 or 4 inches of the fully extended position, the actuating block engages the slide block 48 fixed to the end of the actuating rod 46 and causes the rod to move with the section 20*b* as it completes the final portion of its movement to its fully extended position. This movement of the rod 46 causes the withdrawal of the stop pin 30 against the bias of its spring cylinder 40 to allow rotation of the ladder to the left side of the truck, the side to which the outrigger 20** is being extended.

Figure 10:
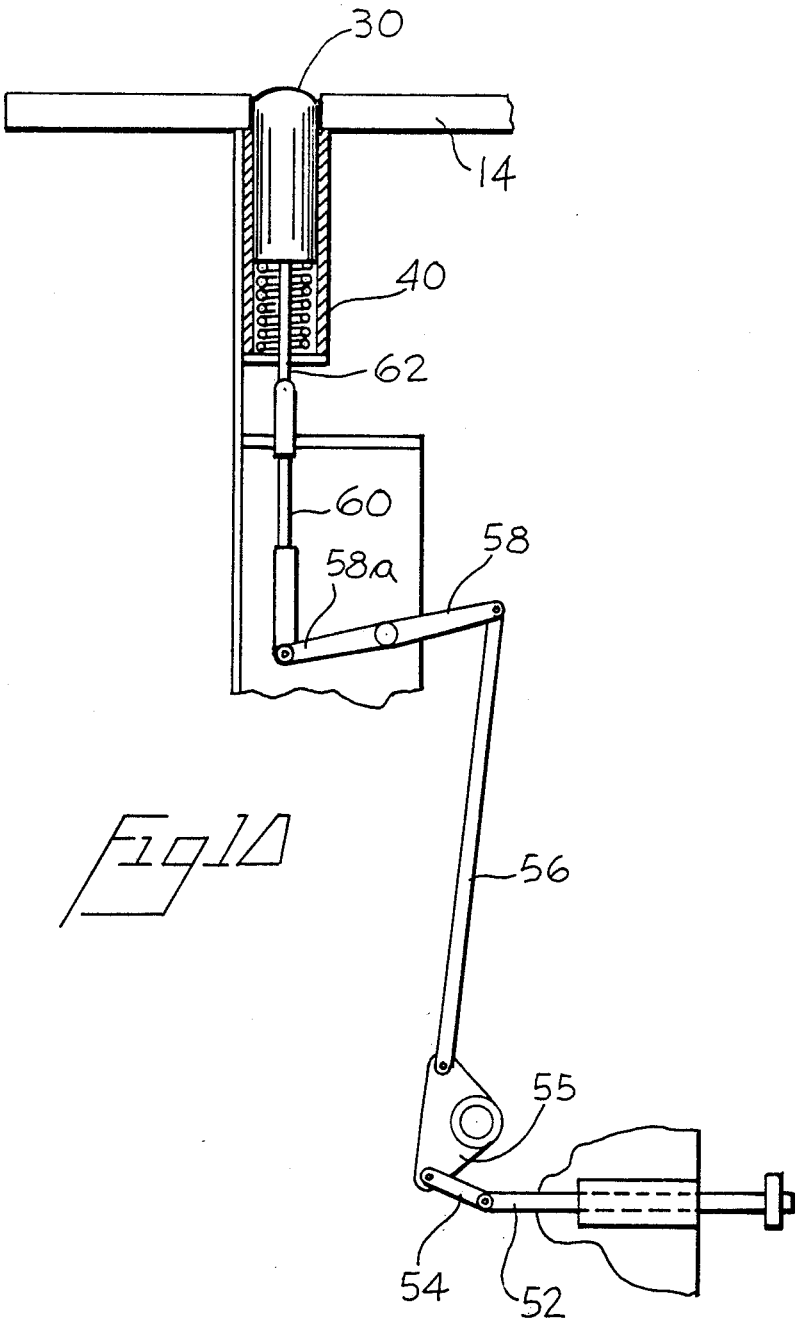
FIG. 10 is a detached view of an operating linkage for a stop pin for controlling ladder rotation.

To effect withdrawal of the stop pin 30, the outer end of the actuating rod 46 is fixedly connected with a slide rod 52 mounted on the outer side of the base section **20*a* of the outrigger 20. As the actuating rod moves with the section 20*b* the slide rod 52 is pushed to move a connecting link 54 which is connected to operate a crank 55 also mounted on the base section. The crank 55 operates a connecting link 56 which extends upwardly from the outrigger 20 across the extended axis of the chassis pivot mount 23*a* for the outrigger, see FIG. 2. The upper end of the connecting link 56 is connected to one end of a pivoted direction changing lever 58 so that as the connecting link 56 moves upwardly as the extendible section is moved to its fully extended position, the end 58*a* of the lever 58 moves downwardly. A connecting link 60 between the end 58*a* and a rod 62 extending downwardly from the pin 30 causes the pin to be retracted against the bias of spring cylinder 40 on the downward movement of the end 58*a* of the pivot lever 58. (See FIG. 10). It is the bias of the spring cylinder 40 acting though the linkage described which prevents the movement of the actuating rod 46 with the section 20*b* until the actuating block 50 engages the slide block 48 to positively move the actuating rod with the extendible section 20*b*. As long as the extendible section remains fully extended, the stop pin 30 will held in a withdrawn position allowing the swinging of the ladder to the left side of the truck. It will be noted that since the stop pin 31 is not withdrawn the ladder cannot be rotated past the stop pin 31** so as to extend from the right side of the truck for which the outrigger has not been set.

Conventional interlocks are used to preclude the outriggers in conjunction with the invention to assure the setting of the jacks and outriggers and to prevent them from being withdrawn until the ladder is returned to its rest position. Such interlocks include fail safe interlocking to lock the hydraulics in case of failures in other parts of the operating systems.

When the outrigger is used as an hydraulic jack, the outrigger 20, for example, the section **20*b* is extended to just beyond the chassis, e.g., a foot or so, and the corresponding cylinder 28 is operated to lower the outrigger against the ground and to pressurize it to lift the chassis of the truck relative to support take the weight of the truck off the adjacent wheels. It will be noted that such operation of outrigger does not effect movement of the actuating parts for withdrawing the stop pin 30**.

The outrigger 22 carries actuating mechanism for the outrigger which is of the same construction and operation as that for the outrigger 20. Parts of the actuating assembly 48', which corresponds to the actuating assembly for the outrigger may be seen in FIG. 3 as well as the linkage between the outrigger and the a rod 64 extending downwardly from the stop pin 31 actuated by the operation of the outrigger 22. The linkage parts shown have been given the same numbers as the corresponding parts of the linkage for the outrigger 20 with a prime mark applied thereto.

What I claim as my invention is:

1. In an apparatus comprising extendible structure having a free end and supported at the other end by a base structure which rotatably supports the extendible structure for rotation in a circumferential path to swing the extendible stucture outwardly of the sides of the apparatus, said extendible structure being pivotablly mounted on base structure for vertical swinging movement about the pivot to raise and lower the outer end thereof, said extendible structure being rotatable to swing said extendible means to a desired circumferential position extending outwardly of the sides of the apparatus and said extendible means having a lowered rest position from which it is raised and swung to one side or the other of said apparatus, outrigger means extendible outwardly of said apparatus for stabilizing the extendible structure when rotated to extend outwardly of a side of said apparatus comprising an outrigger for stabilizing the extendible structure in a predetermined circumferential sector, said outrigger comprising first and second relatively movable telescoping sections, said second section being extendible and retractable relative to said first section between a minimum length storage position and a maximum length extended position for stabilizing the extendible structure, stop rotation means comprising a first element rotatable with said extendible structure and a stop rotation element disposed in the path of said first element for disabling rotation of said extendible means into said sector, means for moving said second section to extend and retract said outrigger, and rotation enabling and disabling means responsive to the extension of said second section as it approaches its fully extended position and moves through a final part of its extension movement for disabling said stop rotation means and enabling the rotation of said extendible structure into said predetermined circumferential sector, and to the initial part of the movement away from said fully extended position for enabling said stop rotation means to disable rotation into said sector.

2. In an apparatus as defined in claim 1, hydraulic cylinder means for lowering said outrigger to place the outer end thereof into contact with the ground for stabilizing purposes including control means for operating said hydraulic cylinder means with said outrigger in extended or retracted positions to enable said outrigger to be moved downwardly when partly extended to function as a stabilizing jack close to the apparatus relative to its fully extended position, the extension of the outrigger for functioning as a jack being insufficient to disable said stop rotation means.

3. In an apparatus as defined in claim 1 which said means for enabling and disabling rotation into said sector comprises actuating means on one of said sections, and cooperating means engagable with said actuating means as the second section approaches its fully extended position to effect the enabling of the rotation of said extendible structure into said sector and to initial movement away from said extended position to disable rotation into said sector.

4. In an apparatus as defined in claim 3 in which said actuating means comprises a fixed element on and movable with said second section and said cooperating means comprises a rod disposed along the path of travel of said second section, said rod having a second element engaged by said fixed element in a predetermined relative position of said first and second sections to actuate said rod as the second section moves to its extended position.

5. In a mobile apparatus having aerial structure laterally swingable into a sector of operation requiring outrigger stabilization and means for precluding rotation into the sector comprising a retractable stop rotation member, an outrigger comprising first and second relatively movable telescoping sections, said second section being extendible from a storage position to an outrigger stabilizing position and retractable to said storage position, actuating means carried by said outrigger comprising first and second elements mounted on said first and second sections respectively, one of said elements being movable with said second section to engage the other of said elements as said second section approaches its fully extended position to actuate the retraction of the said stop rotation member and initiating the resetting of said stop rotation member during the initial portion of movement of said second section away from said fully extended position toward its storage position.

6. In an apparatus as defined in claim 5 in which said first element is fixed to said second section adjacent the inner end thereof and said second element is a movable member yieldably biased to a first position, said movable member having a part thereon engaged by said first element as said second section approaches its fully extended position to move said rod with the second section against said bias to effect movement of said stop rotation member to effect the withdrawal of the stop rotation member and to enable said bias to move said movable member to effect the resetting of said stop rotation member during the initial movement of said second section from said its fully extended position.

7. An outrigger for a mobile apparatus having laterally swingable aerial structure and a retractable stop rotation member for limiting the swinging of the aerial structure unless an outrigger is set, said outrigger comprising first and second relatively moveable telescoping sections, said second section being extendible from a storage position to an outrigger stabilizing position and retractable to said storage position, actuating means carried by said outrigger comprising first and second elements, one of said elements being movable with said second section to engage the other of said elements as said second section approaches its fully extended position to actuate the retraction of said stop rotation member and for effecting the resetting of said stop rotation member as said second section moves away from said fully extended position toward its storage position.

8. An outrigger as defined in claim 7 in which said second element is a rod extending lengthwise of said second section and biased to a first position relative to said first section, and a crank lever on said first section operable to effect withdrawl of said stop rotation member, and connecting means on said first section connecting said rod to actuate said crank lever on movement of rod as said second section approaches and moves away from its fully extended position.

9. In an apparatus as defined in claim 1, 2, 3, 4, 5, or 6 in which said extendible structure is a fire truck and said extendible structure is a ladder mounted on a rotatable platform which is rotated to swing the ladder.

10. In an apparatus as defined in claim 5, hydraulic cylinder means for lowering said outrigger to place the outer end thereof into contact with the ground for stabilizing purposes including control means for operating said hydraulic cylinder means with said outrigger in extended or retracted positions to enable said outrigger to be moved downwardly when partly extended to function as a stabilizing jack close to the apparatus relative to its fully extended position, the extension of the outrigger for functioning as a jack being insufficient to disable said stop rotation means.

* * * * *